US005346311A

United States Patent [19]

Siler et al.

[11] Patent Number: 5,346,311

[45] Date of Patent: Sep. 13, 1994

[54] SEALABLE OPEN-MOUTH BAG

[76] Inventors: Buzz L. Siler, 3328 Lakeview Blvd., Lake Oswego, Oreg. 97035; Daniel R. Garcia, 17905 SW. Pacific Hwy., Tualatin, Oreg. 97062

[21] Appl. No.: 124,154

[22] Filed: Sep. 20, 1993

[51] Int. Cl.[5] ..... B65D 33/30

[52] U.S. Cl. ..... 383/75; 383/33; 383/104

[58] Field of Search ..... 383/33, 35, 71, 74, 383/75, 104; 4/144.1, 144.2

[56] References Cited

U.S. PATENT DOCUMENTS

| | | | |
|---|---|---|---|
| 2,999,627 | 9/1961 | Reinhardt | 383/104 X |
| 3,403,410 | 10/1968 | Benzel et al. | 4/144.2 |
| 3,659,777 | 5/1972 | Kanada et al. | 383/104 X |
| 3,738,567 | 6/1973 | Ruda . | |
| 4,537,432 | 8/1985 | Meeks . | |
| 4,785,960 | 11/1988 | Belisle | 383/75 X |
| 5,044,774 | 9/1991 | Bullard . | |
| 5,116,139 | 5/1992 | Young et al. | 383/36 X |
| 5,160,196 | 11/1992 | Curtis | 383/76 X |

FOREIGN PATENT DOCUMENTS

| | | | |
|---|---|---|---|
| 2227728 | 8/1990 | United Kingdom | 383/36 |

*Primary Examiner*—Allan N. Shoap
*Assistant Examiner*—Jes F. Pascua
*Attorney, Agent, or Firm*—Olson & Olson

[57] ABSTRACT

A flexible bag is formed with a peripheral sleeve provided about its open end, and a stiff, resilient locking strap is contained within the peripheral sleeve, the terminal ends of the strap exiting the sleeve on the outside of the bag for connection to each other through a locking-type fastener member, whereby the resiliency of the strap member retains the bag normally in fully open condition and by cinching the strap fully the bag is closed into sealed, substantially water-tight condition against re-opening. An encircling apron member may be provided about the open end of the bag to provide a convenient hand grasp for holding the bag during use and for stabilizing the open end of the bag against tipping when the bag is disposed on an underlying surface during use.

2 Claims, 3 Drawing Sheets

SEALABLE OPEN-MOUTH BAG

BACKGROUND OF THE INVENTION

This invention relates to flexible bags which include structure to close and seal the open end thereof, and more particularly to a novel bag construction that is arranged with a strap member that is configured to hold the open end of the bag in fully open condition during use and further operates to quickly and easily close the open end of the bag in sealed, positively locked condition after use.

Drawstring-type bags and pouches are well known and age-old in the art, as also are twist-tie-type bag closure members and locking strap members that are used to simply tie a bag closed after it has been filled. Illustrative of such are U.S. Pat. Nos. 3,738,567 to a drawband closure bag and U.S. Pat. No. 4,537,432 to a security seal which may be used to secure a bag in closed condition. While such bag closure devices and constructions may serve adequately to close the open end of a bag, none are known that are intended or operable to also retain the open end of a bag in fully open condition for filling, etc. U.S. Pat. No. 5,044,774 teaches a bag having a stiff strip around the mouth of the bag that is configured to hold the bag top in open condition, however this construction is not capable of or intended to close the bag securely after filling.

Applicant has discovered that there is currently a need present in a number of areas for a convenient bag construction in which the open end is retained in a fully open condition for filling and the bag is further configured for quick and secure sealing after being used. For example, paramedics and medical workers frequently encounter situations where patients may suddenly begin vomiting with very little forewarning. In such cases, it is extremely advantageous to have close at hand a plastic bag that is pre-opened and retained in an open condition such that it may be grabbed and instantly positioned and held in place for the patient without any fumbling in trying to open the bag and keep it open in such a situation. Obviously, accompanying that need is the need to quickly close the bag so that it is sealed against spillage with a minimum of involvement so that the paramedic may return his attention to his patient without further concern over the bag or the possibility of its contents inadvertently spilling and contaminating the field. Such bag features are also advantageous in the handling of contaminated materials in the medical arena.

SUMMARY OF THE INVENTION

In its basic concept this invention provides a flexible bag having an annular sleeve provided about the open end thereof, and a resilient strap member contained freely within the sleeve and configured to retain the bag in fully open condition for filling, the strap further operable to close and seal the bag against spillage after it has been filled.

It is by virtue of the foregoing basic concept that the principal objective of this invention is achieved; namely, the provision of a flexible bag that is equipped both for remaining wide open for easy filling and for secure sealing against spillage after filling.

Another object of this invention is the provision of a flexible bag of the class described in which the open end of the bag is retained in fully open condition for immediate use, until it is physically closed into locked, sealed condition.

Another object of this invention is the provision of a flexible bag of the class described which may also include an encircling apron member about the open end thereof, the apron member providing a convenient hand grasp for holding the bag during filling and also serves as a support member about the open end of the bag that prevents the open end of the bag from tilting or tipping when the bag is disposed on an underlying surface in open condition, to prevent inadvertent spillage of liquid contents of the bag.

A still further object of this invention is the provision of a flexible bag of the class described which, when closed into sealed condition, is positively locked against re-opening without producing visible damage to the bag or the locking strap, whereby the accessing of the interior of the bag after sealing will be visibly evidenced.

The foregoing and other objects and advantages of this invention will appear from the following detailed description, taken in connection with the accompanying drawings of preferred embodiments.

DESCRIPTION OF THE PREFERRED EMBODIMENT

Figure 1:
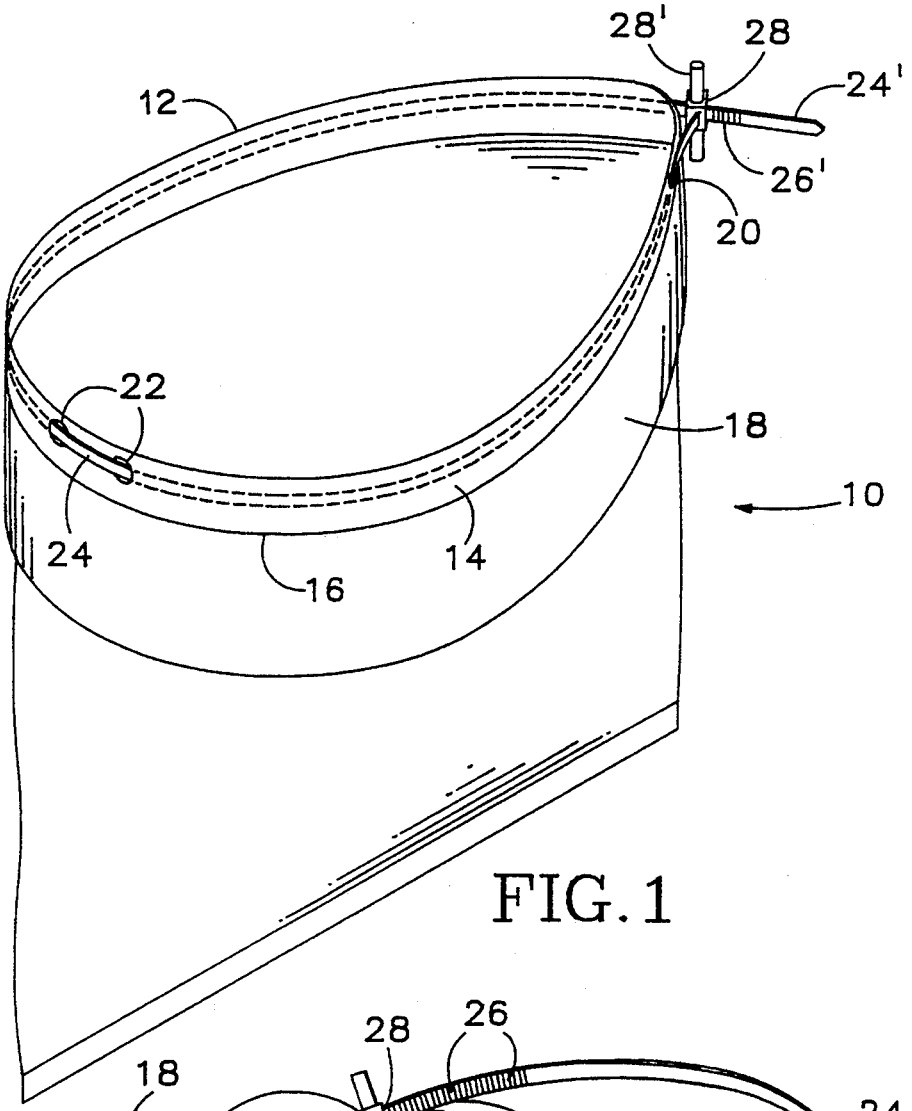
FIG. 1 is a perspective view of a bag construction embodying the features of this invention.
Figure 2:
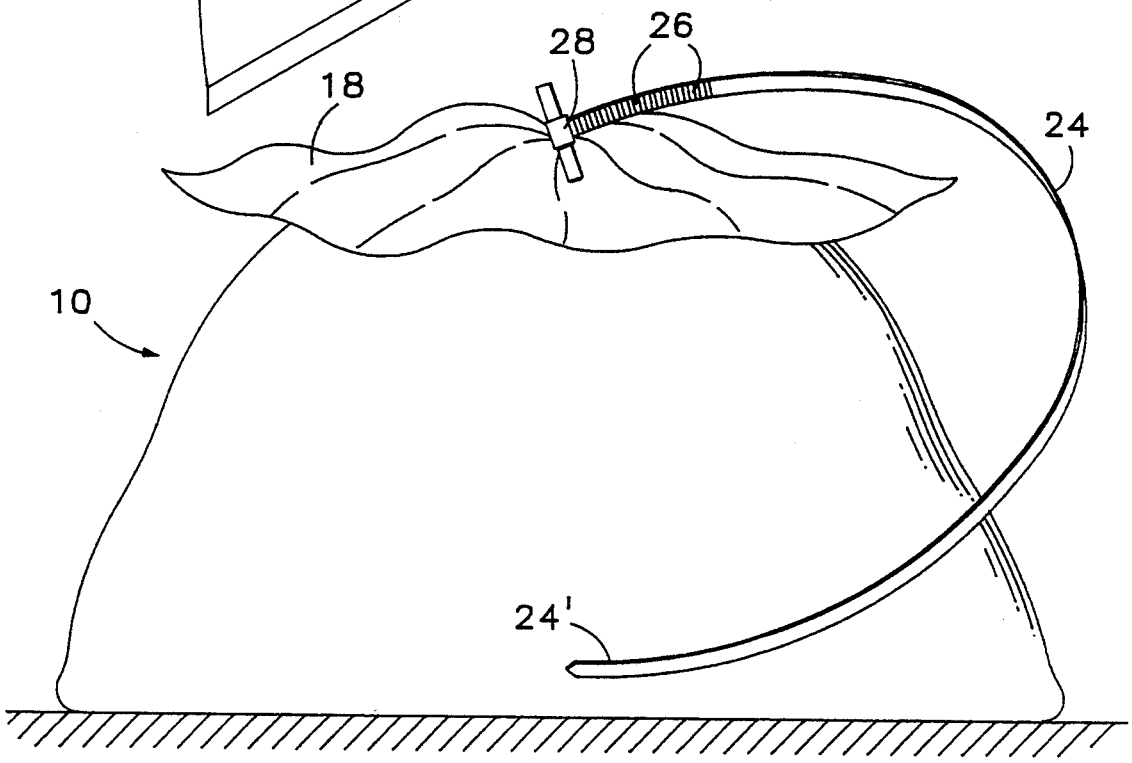
FIG. 2 is a side elevation of the bag of FIG. 1 shown in closed, sealed condition after filling.

FIG. 1 illustrates a bag embodying the features of this invention. Although the bag in the preferred embodiments shown here are illustrated as plastic, liquid-holding bags, it is to be understood that any suitable, flexible material may be used in the bag construction as desired or needed for an intended use. With that understood, there is shown a flexible bag 10 which may be configured in any size or shape as may be desired, the bag having a closed bottom and sides, and an open top end 12.

In the embodiment illustrated, a peripheral sleeve 14 is formed on the outside of the bag to encircle the open end thereof, and in the preferred embodiment illustrated, this is done by folding the upper portion of a bag downwardly about the outside of the bag and fusing 16 the folded portion to the bag a spaced distance downwardly from the top thereof, forming a tunnel-like pocket about the outer periphery of the bag immediately adjacent its open end. Of course it is to be understood that, depending on the type of material being used in the bag construction, any suitable, conventional method may be used to secure the folded-over portion of the bag to the bag side walls as may be appropriate, such as heat fusing, bonding, stitching, and the like. As shown, the bag construction preferably includes an apron member 18 which extends downwardly from the upper, open portion of the bag for reasons which will be explained later. For simplicity in construction, this apron member in the preferred embodiment is configured as an extension of the folded-over top portion of the bag extending beyond the fuse line 16 to a point that is approximately the mid point of the height of the finished bag. Longer or shorter aprons, or no apron at all, may of course be provided as desired.

With reference now to the peripheral sleeve 14 formed about the outside of the bag immediately adjacent its open end, access to the interior confines of the sleeve is provided. In this embodiment, openings 20, 22 are provided through the outer wall surface of the sleeve preferably at diametrically opposite points on the sleeve. In the preferred form shown, these openings are provided as closely adjacent pairs of holes which have been found desirable in both the assembly of the bag and the sealing operation, both of which will be described in due course.

Having thus described the basic features of the bag construction itself, attention is now directed to the strap member 24 which provides means for both retaining the bag in fully open condition and closing the bag into sealed condition. In the preferred form of the invention, this strap member comprises a longitudinally elongated length of resilient material such as synthetic thermoplastic resin, wire or the like. In the embodiment illustrated in FIGS. 1–5 the strap 24 is formed of a synthetic thermoplastic resin and includes locking notches 26 and a corresponding fastener member 28 generally similar in overall concept to the security seal disclosed in U.S. Pat. No. 4,537,432. The strap member is dimensioned to be carried within the sleeve so that its opposite terminal ends may extend outside of the sleeve through holes 20 as shown, when the open end of the bag is in fully open condition as will be understood from the drawings. In assembly, one terminal end 24' of the strap is inserted through one opening hole 20, guided through the interior of the sleeve and out of the sleeve through the corresponding opening hole 22 on the opposite side of the bag, whereupon the strap is re-directed back into the sleeve through the adjacent opening 22, through the remainder of the sleeve and exiting the sleeve through the corresponding opposite opening hole 20 on the original side of the bag. The terminal end 24' of the strap is then engaged with the fastener member 28 on the opposite terminal end of the strap as shown. The resulting hoop that is formed by the resilient strap member is inherently tensioned outwardly by virtue of the resiliency of the strap material, and hence the open end of the bag is automatically opened and retained in fully open condition by that outward tension. Accordingly, the bag is always ready for immediate use without any need of any effort directed at opening the bag or holding it open during use.

Still with reference to the strap, locking notches 26 or teeth are preferably provided on the strap extending approximately two to three inches from its end mounting the fastener member 28, the remainder of the strap being allowed free passage through the fastener member in both directions. If desired, locking notches 26' may be provided at the opposite terminal end to prevent inadvertent separation of the strap through the fastener member. This particular locking notch configuration is desirable in order to allow the loop formed by the strap to be adjustable in size so that the size of the bag opening may be varied as needed. Accordingly, while the strap can be drawn in either direction through the fastener member to size the opening of the bag as needed, the fastener means will engage the one-way locking notches 26 to prevent enlargement of the loop only during the final two or three inches of the strap when the bag is nearly in fully closed condition. Finger tabs 28' may be provided on the fastener member 28 to facilitate the holding of the fastener member while the strap is being pulled therethrough.

Those skilled in the art will understand that as the strap is pulled through the fastener member and the diameter of the loop is reducing the size of the bag opening, the bag material is bunched or gathered into more and more tightly-compressed pleats or gathers on the stiff strap member. When the strap member is pulled to its limit through the fastener member, the bag material is compressed into a multiplicity of tightly compacted gathers that effectively close the bag in a substantially water-tight, sealed condition. The configuration of the locking notches and the fastening member on the strap prevent the bag from re-opening or loosening into a non-water-type seal.

Those skilled in the art will further recognize that, by virtue of this particular, one-way locking strap configuration, once the bag has been sealed, it cannot be reopened again without cutting the strap or the bag, and thereby evidencing the tampering. Accordingly, the bag of the present invention also finds particular utility as an evidence bag for use by police and the courts, property bags in jails, hospitals, hotels, etc. and other such uses.

The adjustable and resilient configuration of the strap member 24 also advantageously serves in other intended uses of the bag of this invention. The bag is well adapted for use as a urine bag for both males and females. For males, the opening is adjusted to a desired diameter and the bag used much as a bottle or a medical urinal, the stiffness of the strap serving to rigidify the bag for positioning and holding. With females, the bag is positioned between the legs, the inherent resiliency of the stiff strap permitting the open end of the bag to conform snugly to the contour of the thighs while retaining the bag in as fully open a condition as is permitted while also helping to retain the bag against inadvertent movement or slippage. The apron 18 providing a hand-grasp by which to hold the bag securely in place during use. Once finished, the bag is closed and sealed by pulling the free end 24' of the strap fully through the fastener member until it can be pulled no more, whereupon the bag is sealed against inadvertent spillage until eventual discard. In similar manner, the adjustable and resilient nature of the open end of the bag of this invention lends itself to a multiplicity of other uses in which it is advantageous that a flexible bag be retained in open condition yet also remain resiliently deformable to accommodate placement in confined and contoured spaced while remaining as open as possible.

From the foregoing it will be apparent to those skilled in the art that the present invention embodied in FIGS. 1–5 provides a unique bag construction in which its open end is normally retained in resiliently deformable, fully opened condition ready for immediate use, and is also quickly and easily closable by simply pulling the strap through its associated fastener member to cinch the open end of the bag into closed, sealing condition.

Figures 3, 4, 5, 6:
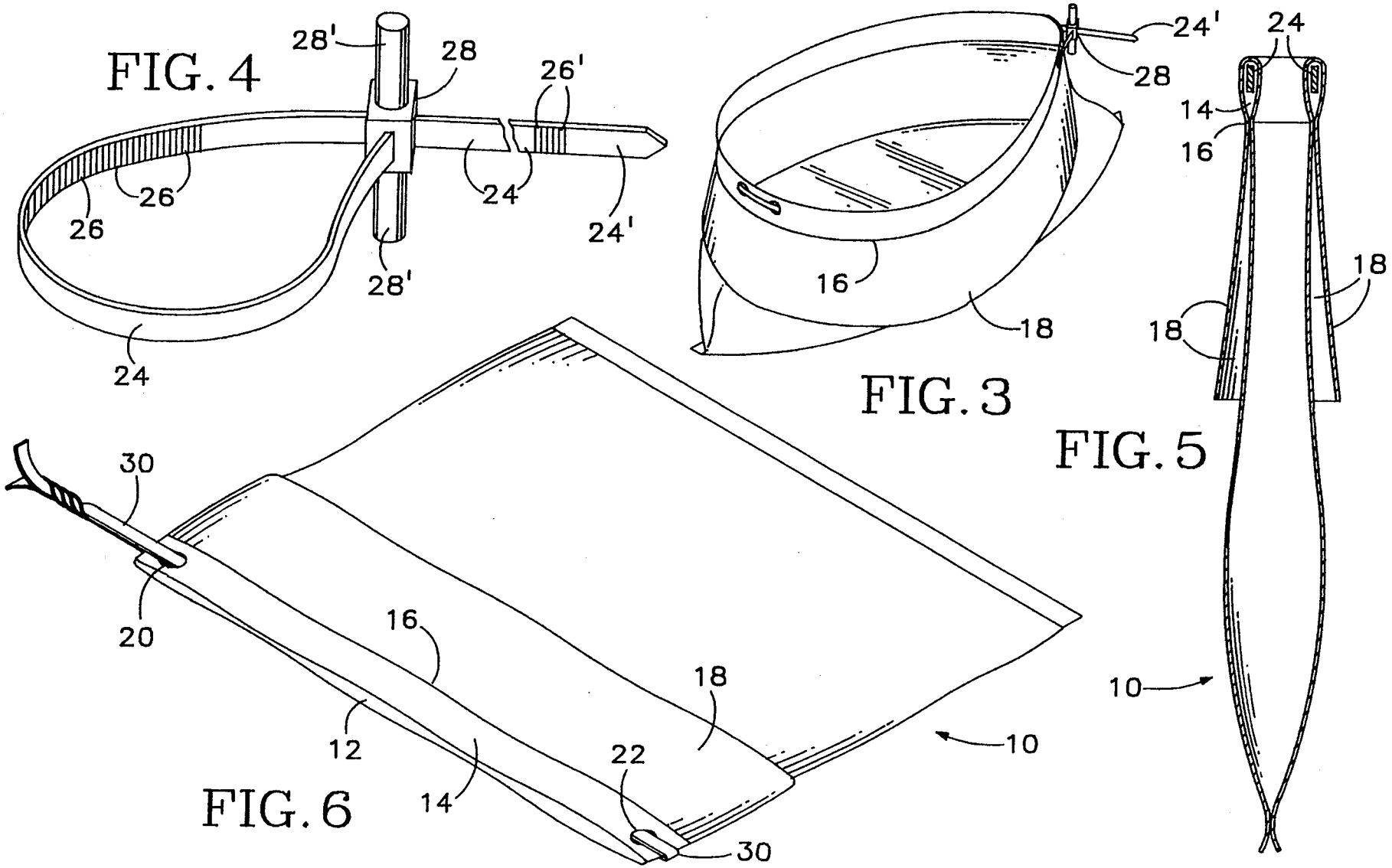
FIG. 3 is a perspective view of the bag of FIG. 1, on a reduced scale, showing the apron member in use to stabilize and support the open end of the bag for use when the bag is disposed in bowl-like condition on an underlying surface.
FIG. 4 is a foreshortened, perspective view of the resilient locking strap member that is used in the bag construction embodied in FIG. 1.
FIG. 5 is a sectional view of a bag construction embodying the features of this invention.
FIG. 6 is a perspective view of another embodiment of the bag construction of this invention utilizing an alternative strap member that permits the bag to assume a flat condition for packaging and storage prior to use.

As illustrated in FIG. 3 of the drawings, the apron member 18 serves an additional function besides that of providing a hand grasp for holding and carrying the bag during use. As illustrated, since the mouth of the bag of the present invention is retained in a fully opened condition, the bag may be disposed on an underlying surface, such as a table, and used in bowl-like fashion for a variety of uses. The apron, extending downwardly from the resiliently held-open end, provides an encircling support for the open end which directly supports the open end above the underlying surface to prevent total collapse of the bag and any tipping or sagging of the open end into a position which might allow spillage.

Figure 7:
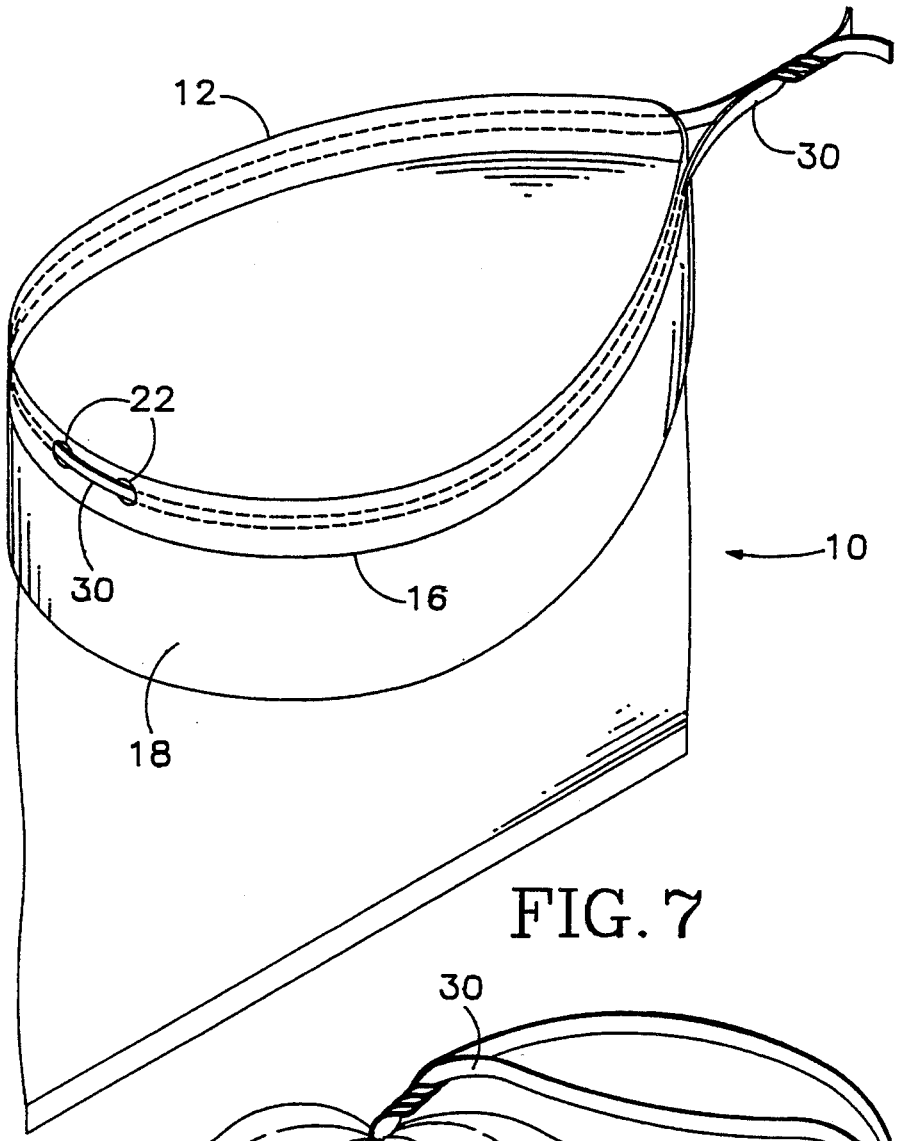
FIG. 7 is a perspective view of the bag construction of FIG. 6 showing the bag in open condition for use.
Figure 8:
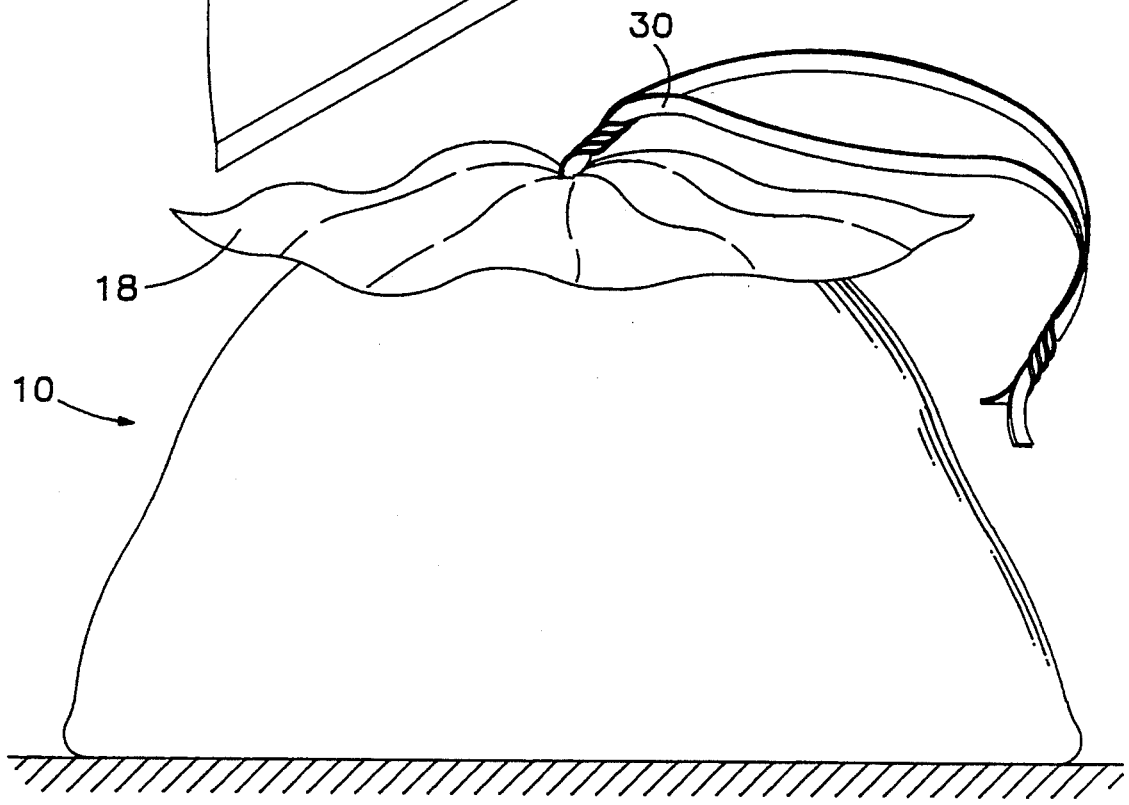
FIG. 8 is a side elevation of the bag of FIG. 7 in closed, sealed condition.

With reference to FIGS. 6–8 of the drawings, a second embodiment of the invention is shown which also serves the intended purpose of this invention. In this form of the invention, the resilient locking strap member 24 discussed previously is replaced with a wire strap member 30 that is stiff but maleable in its configuration. In this manner, the bag may be provided for packaging and storage in the flat, closed condition of FIG. 6, and be quickly and easily grasped and pulled into the open condition of FIG. 7. Once opened into this condition, the wire strap 30, by virtue of its inherent stiffness, maintains its hoop configuration and thereby retains the bag in fully open condition with a degree of resiliency that allows it to deform and be contoured similarly to that described in connection with the foregoing embodiment of the invention. To close and seal the bag, the wire is pressed back to the closed condition of FIG. 6 and the top, sleeve portion of the bag pinched by the fingers and slid along the strap into a "bunched" condition, whereupon the strap 30 is twisted a sufficient number of turns to compress the gathered bag material tightly into the sealed condition of FIG. 8.

From the foregoing it will be apparent to those skilled in the art that various changes may be made in addition to those described previously in the size, shape, type, number and arrangement of parts described hereinbefore without departing from the spirit of this invention and the scope of the appended claims. For example, although the strap locking means illustrated herein comprises locking notches and a corresponding "buckle-type" fastener member, any other suitable locking arrangement may alternatively be used, such as an infinitely adjustable, releasable friction-lock type fastener or the like. Additionally, it may be desirable in certain uses that the strap be freely adjustable without being lockable at all, or be re-openable after closing, as in the case of temporary-use cover bags and the like. Accordingly, various strap adjustment and strap lock arrangements are anticipated.

Having thus described our invention and the manner in which it may be used, we claim:

1. A flexible bag having an open top end configured to be releasably retained in a fully open condition, the bag comprising:

a) a bag body of flexible material forming closed side walls, a closed bottom end, an open top end, and a hollow interior thereinbetween, b) a peripheral sleeve on the bag body adjacent to and encircling the open top end thereof, the sleeve forming an enclosed, hollow, peripheral pocket about the open top end of the bag body, c) an elongated strap member having opposite end portions, the strap member being freely contained within the sleeve and encircling the open top end of the bag body, the opposite end portions of the strap member exiting the sleeve closely adjacent each other and configured for connection to each other outside of the sleeve, the strap member configured, with its opposite end portions connected together, to form an outwardly-tensioned hoop that retains the top end of the bag body in fully open condition, and d) a flexible, bag-encircling apron member secured at an upper edge on the bag body adjacent the open end thereof and extending downwardly therefrom about the outside of the side walls of the bag body, the apron member configured to support an upper portion of the bag body a spaced distance above an underlying surface upon which the bag is to be disposed and maintain the open top end of the bag body in a substantially level, bowl-like condition against tilting and collapse to prevent inadvertent spillage of the contents of the bag.

2. The flexible bag of claim 1 wherein an upper portion of the side walls include a reverse fold and said upper portion extends downwardly therefrom about the outside of the bag body and is secured thereto along a circumferential attachment line about the bag body disposed a spaced distance below the reverse fold and defining said peripheral sleeve thereinbetween, and said apron member comprises an extension of said upper portion extending downwardly from said circumferential attachment line.

* * * * *